US009108444B2

(12) United States Patent
Satake

(10) Patent No.: US 9,108,444 B2
(45) Date of Patent: Aug. 18, 2015

(54) CONVEYOR DEVICE AND IMAGE FORMING APPARATUS

(71) Applicant: KYOCERA DOCUMENT SOLUTIONS INC., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/141,294

(22) Filed: Dec. 26, 2013

(65) Prior Publication Data

US 2014/0184716 A1 Jul. 3, 2014

(30) Foreign Application Priority Data

Dec. 27, 2012 (JP) ..... 2012-285245

(51) Int. Cl.

| | |
|---|---|
| ***B41J 2/01*** | (2006.01) |
| ***B41J 11/00*** | (2006.01) |
| ***B65H 5/22*** | (2006.01) |

(52) U.S. Cl.

CPC ..... *B41J 11/0085* (2013.01); *B41J 11/007* (2013.01); *B65H 5/224* (2013.01); *B65H 2406/3223* (2013.01); *B65H 2406/361* (2013.01); *B65H 2406/3622* (2013.01)

(58) Field of Classification Search

CPC ..... B41J 11/0085

See application file for complete search history.

(56) References Cited

U.S. PATENT DOCUMENTS

| | | | | |
|---|---|---|---|---|
| 8,287,084 | B2 * | 10/2012 | Ito | 347/23 |
| 2009/0244242 | A1 * | 10/2009 | Sawada | 347/104 |
| 2011/0292145 | A1 * | 12/2011 | Hoover et al. | 347/104 |

FOREIGN PATENT DOCUMENTS

| | | | |
|---|---|---|---|
| JP | 2009-154985 | A | 7/2009 |
| JP | 2010-280149 | A | 12/2010 |

* cited by examiner

*Primary Examiner* — Matthew Luu
*Assistant Examiner* — Tracey McMillion
(74) *Attorney, Agent, or Firm* — Studebaker & Brackett PC

(57) ABSTRACT

Multiple suction holes are formed in a conveyance belt of a conveyor device. A suction unit is arranged on one of surfaces of the conveyance belt. The suction unit includes a unit case. The unit case includes a plurality of cells arranged side by side in the width direction of the conveyance belt and in a conveyance direction of paper. A fan is provided in each of the plurality of cells.

12 Claims, 4 Drawing Sheets

CONVEYOR DEVICE AND IMAGE FORMING APPARATUS

INCORPORATION BY REFERENCE

The present application claims priority under 35 U.S.C. §119 to Japanese Patent Application No. 2012-285245, filed Dec. 27, 2012. The contents of this application are incorporated herein by reference in their entirety.

BACKGROUND

The present disclosure relates to conveyor devices included in image forming apparatuses such as printers, copiers, multifunction peripherals, etc. and image forming apparatuses.

Inkjet recording apparatuses that form an image on a recording medium such as paper, etc. by ejecting ink droplets from multiple nozzles are widely used in printers, copiers, multifunction peripherals, etc. because of its compactness, inexpensiveness, low operating noise, etc.

In an inkjet recording apparatus, a conveyance belt conveys a recording medium such as copy paper, etc. A recording head ejects ink droplets to the recording medium to form an image on the recording medium. The recording head is arranged at a distance of about 1.0-1.5 mm from a recording medium so as not to come in contact with the recording medium.

In the inkjet recording apparatus having such a structure, when a recording medium comes off from the conveyance belt by sag of the recording medium, wind pressure caused due to the recording medium passing under the recording head, or the like, the distance between the recording medium and the recording head varies. This may impair image quality.

In order to address the above described problem, a conveyor device that sucks a recording medium on the conveyance belt is proposed. Some conveyor devices include a conveyance belt driven in a conveyance direction of a recording medium and a suction unit arranged on one of the surfaces of the conveyance belt. Multiple suction holes are formed in the conveyance belt.

The suction unit includes a fan case and a fan provided in the fan case. Holes or slits are formed in a ceiling wall of the fan case so as to communicate the interior of the fan case with the suction holes of the conveyance belt.

When the fan is driven with the recording medium loaded on the other surface of the conveyance belt, negative pressure is generated in the fan case to act on the recording medium through the suction holes of the conveyance belt. Thus, the recording medium is sucked on the other surface of the conveyance belt.

SUMMARY

In the first aspect of the present disclosure, a conveyor device which conveys a recording medium includes: a conveyance belt in which multiple suction holes are formed and which is driven in a conveyance direction of the recording medium; and a suction unit arranged on one of surfaces of the conveyance belt and configured to generate negative pressure to suck the recording medium on the other surface of the conveyance belt through the multiple suction holes. The suction unit includes: a unit case including a plurality of cells arranged side by side at least in a width direction of the conveyance belt; and a suction section provided in each of the plurality of cells and configured to generate the negative pressure.

Further, in the second aspect of the present disclosure, an image forming apparatus includes: a conveyor device configured to convey a recording medium; and an image forming section configured to form an image on the recording medium. The conveyor device includes: a conveyance belt in which multiple suction holes are formed and which is driven in a conveyance direction of the recording medium; and a suction unit arranged on one of surfaces of the conveyance belt and configured to generate negative pressure to suck the recording medium on the other surface of the conveyance belt through the multiple suction holes. The suction unit includes: a unit case including a plurality of cells arranged side by side at least in a width direction of the conveyance belt; and a suction section provided in each of the plurality of cells and configured to generate the negative pressure.

DETAILED DESCRIPTION

Figure 1:
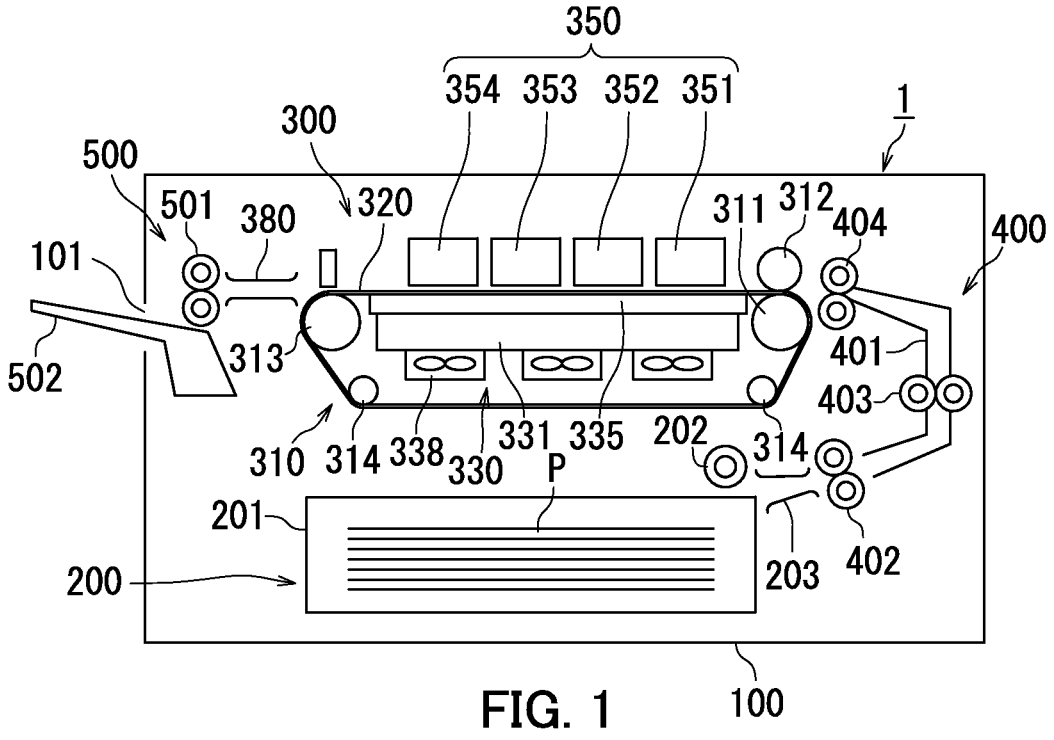
FIG. 1 is a schematic illustration showing a general configuration of an inkjet recording apparatus including a conveyor device for recording medium according to the first embodiment of the present disclosure.

Embodiments according to the present disclosure will be described below with reference to the accompanying drawings. FIG. 1 is a schematic illustration showing a general configuration of an inkjet recording apparatus 1 including a conveyor device for recording medium (hereinafter, referred to as "conveyor device") according to the first embodiment of the present disclosure.

The inkjet recording apparatus 1 includes a device casing 100, a paper feed section 200 arranged in the lower part of the device casing 100, an image forming section 300 employing an inkjet recording method and arranged above the paper feed section 200, a paper conveyance section 400 arranged on one side of the image forming section 300, and a paper ejection section 500 arranged on the other side of the image forming section 300.

The paper feed section 200 includes a paper feed cassette 201 detachably mounted in the device casing 100, a paper feed roller 202, and a guide plate 203. The paper feed roller 202 is arranged above the paper feed cassette 201 on one side thereof. The guide plate 203 is arranged between the paper feed roller 202 and the paper conveyance section 400.

Multiple sheets of paper P are accommodated in the paper feed cassette 201 in a layered manner. The paper feed roller 202 takes out paper P in the paper feed cassette 201 on a paper-by-paper basis. The guide plate 203 guides the paper P taken out by the paper feed roller 202 to the paper conveyance section 400.

The paper conveyance section 400 includes a substantially C-shaped paper conveyance path 401, a first conveyance roller pair 402 provided at the inlet of the paper conveyance path 401, a second conveyance roller pair 403 provided in the central part of the paper conveyance path 401, and a registration roller pair 404 provided at the outlet of the paper conveyance path 401.

The first conveyance roller pair 402 sandwiches paper P fed from the paper feed section 200 and sends out the paper P to the paper conveyance path 401. The second conveyance roller pair 403 sandwiches the paper P sent out by the first conveyance roller pair 402 and conveys the paper P in a conveyance direction. The registration roller pair 404 corrects skew of the paper P conveyed by the second conveyance roller pair 403. Then, the registration roller pair 404 temporarily stops the paper P in order to synchronize conveyance of the paper P with printing and then sends out the paper P to the image forming section 300 with timing of printing.

The image forming section 300 includes a conveyor device 310, a recording head 350 arranged above the conveyor device 310, and a conveyance guide 380 arranged downstream of the conveyor device 310 in the conveyance direction of the paper P. It is noted that the image forming section 300 may include a dryer to dray ink droplets ejected onto the paper P.

The conveyor device 310 includes a support roller 311, a paper retention roller 312, a drive roller 313, a pair of tension rollers 314, an endless conveyance belt 320, and a suction unit 330. The conveyance belt 320 is wound between the support roller 311, the drive roller 313, and the pair of tension rollers 314.

The paper retention roller 312 is arranged above the support roller 311 to sandwich paper P between itself and the support roller 311 and send out the paper P onto the conveyance belt 320. The drive roller 313 is arranged at a distance from the support roller 311 in the conveyance direction of the paper P. A motor (not shown) drives and rotates the drive roller 313 to rotate the conveyance belt 320 in the counterclockwise direction. The pair of respective tension rollers 314 is arranged below the support roller 311 and the drive roller 313 between the support roller 311 and the drive roller 313 and applies tension to the conveyance belt 320 so as to prevent the conveyance belt 320 from sagging.

The recording head 350 is made up of four line heads 351, 352, 353, and 354 arranged side by side from the upstream side to the downstream side of the conveyance direction of paper P. Each of the line heads 351, 352, 353, and 354 includes multiple nozzles (not shown) arranged in the width direction of the paper P (direction in parallel with one of the surfaces of the paper P and orthogonal to the conveyance direction of the paper P). The recording head 350 is called a line type recording head.

Each of the multiple nozzles of the line head 351 is in communication with a pressurizing chamber (not shown) formed in the line head 351. The pressurizing chamber is in communication with an ink chamber formed in the line head 351. Further, the ink chamber is connected to and in communication with a black (K) ink tank (not shown) through an ink supply tube (not shown).

Each of the multiple nozzles of the line head 352 is in communication with a pressurizing chamber (not shown) formed in the line head 352. The pressurizing chamber is in communication with an ink chamber formed in the line head 352. Further, the ink chamber is connected to and in communication with a cyan (C) ink tank (not shown) through an ink supply tube (not shown).

Each of the multiple nozzles of the line head 353 is in communication with a pressurizing chamber (not shown) formed in the line head 353. The pressurizing chamber is in communication with an ink chamber formed in the line head 353. Further, the ink chamber is connected to and in communication with a magenta (M) ink tank (not shown) through an ink supply tube (not shown).

Each of the multiple nozzles of the line head 354 is in communication with a pressurizing chamber (not shown) formed in the line head 354. The pressurizing chamber is in communication with an ink chamber formed in the line head 354. Further, the ink chamber is connected to and in communication with a yellow (Y) ink tank (not shown) through an ink supply tube (not shown).

The suction unit 330 is arranged on one of the surfaces of the conveyance belt 320 to face the recording head 350 with the conveyance belt 320 interposed therebetween. The present embodiment shows the case where the suction unit 330 is arranged on the reverse surface of part of the conveyance belt 320 which is located on the upper side of the conveyance belt 320. The suction unit 330 includes a fan case 331 as a unit case, a ceiling wall 335 covering a top opening of the fan case 331, and a plurality of fans 338 provided in the fan case 331. The fans 338 each function as a suction section in the present disclosure.

The conveyance guide 380 guides paper P ejected from the conveyance belt 320 to the paper ejection section 500.

The paper ejection section 500 includes an ejection roller pair 501 and an exit tray 502. The exit tray 502 is fixed to the device casing 100 so as to protrude outside an exit port 101 formed in the device casing 100.

Paper P which has passed through the conveyance guide 380 is sent out toward the exit port 101 by the ejection roller pair 501 and is guided to the exit tray 502 to be ejected outside the device casing 100 through the exit port 101.

Figure 2:
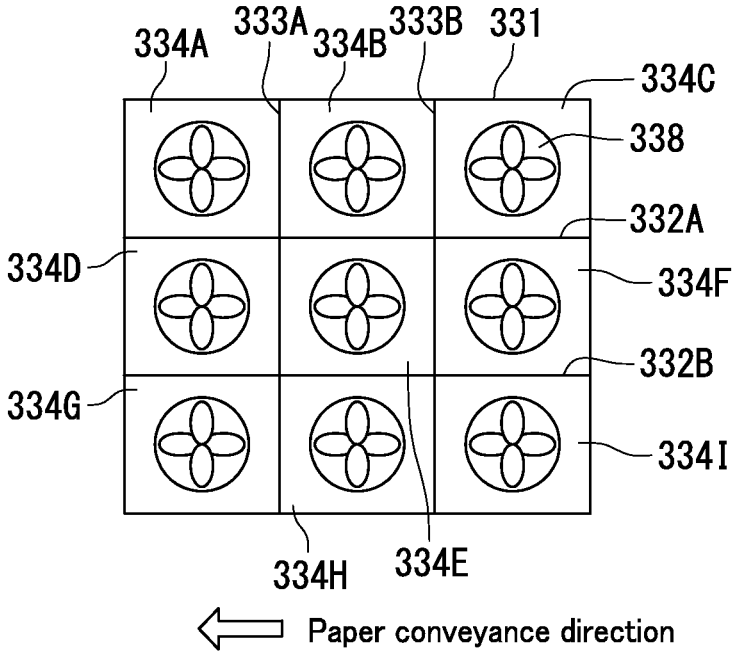
FIG. 2 is a plan view showing a state of an interior of a fan case shown in FIG. 1.

FIG. 2 is a plan view showing a state of the interior of the fan case 331 shown in FIG. 1.

The fan case 331 has a box shape with its top opened. The interior of the fan case 331 is partitioned by a pair of partition walls 332A and 332B, which horizontally traverses the interior of the fan case 331 in the conveyance direction of paper P, and by a pair of partition walls 333A and 333B, which vertically traverses the interior of the fan case 331 in the width direction of the conveyance belt 320 (direction in parallel with the one surface of the conveyance belt 320 and orthogonal to the conveyance direction of the paper P). The fan case 331 includes nine cells 334A to 3341, which have the same shape and size, arranged side by side in the width direction of the conveyance belt 320 and in the conveyance direction of the paper P.

Each of the cells 334A to 3341 includes a fan 338. As shown in FIG. 1, the fans 338 are provided in the cells 334A to 3341 so that the lower portion of each of the fans 338 protrudes downward from the fan case 331. Each of the fans 338 is connected to a power source (not shown).

Figure 3:
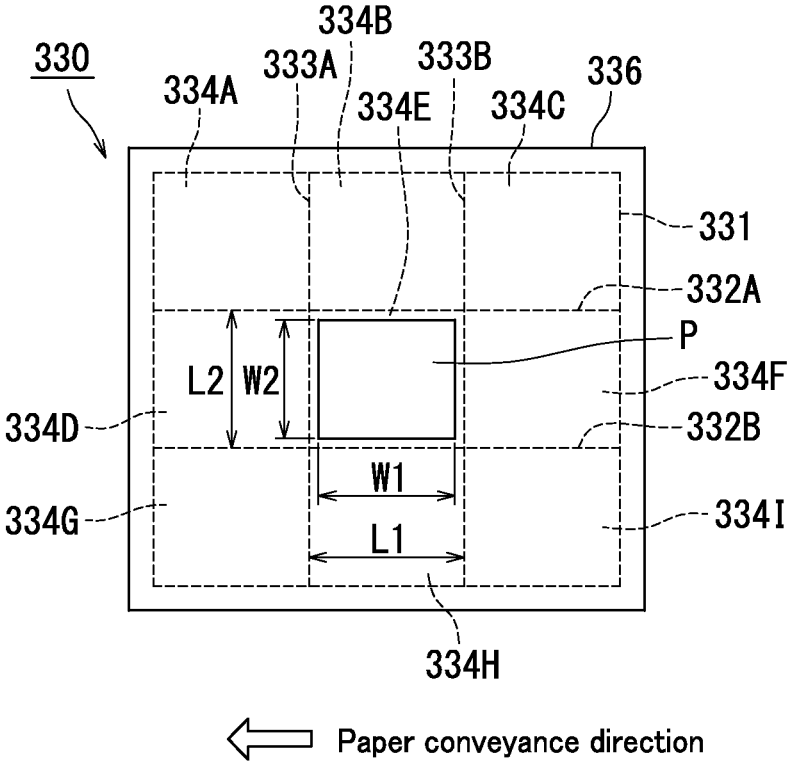
FIG. 3 is an explanatory illustration showing the relationship between a suction unit shown in FIG. 1 and paper.

FIG. 3 is an explanatory illustration showing the relationship between the suction unit 330 of the conveyor device 310 shown in FIG. 1 and paper P. The paper P shown in FIG. 3 has minimum size among paper which the conveyor device 310 is capable of conveying.

A distance L1 between the partition wall 333A and the partition wall 333B is slightly larger (e.g., 1 cm) than a width W1 of the paper P. A distance L2 between the partition wall 332A and the partition wall 332B is slightly larger than a width W2 of the paper P.

Figure 4:
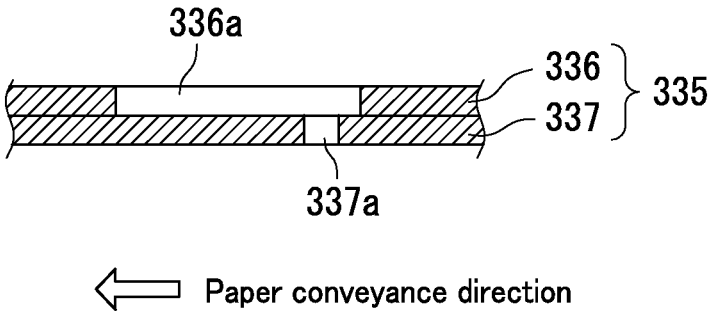
FIG. 4 is a partially enlarged cross sectional view of a ceiling wall shown in FIG. 1.
Figure 5:
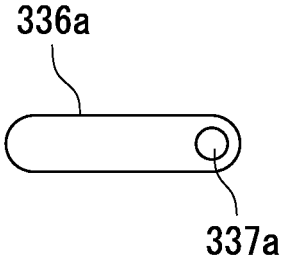
FIG. 5 is a partially enlarged plan view of the ceiling wall shown in FIG. 1.

FIG. 4 is a partially enlarged cross sectional view of the ceiling wall 335 shown in FIG. 1. FIG. 5 is a partially enlarged plan view of the ceiling wall 335 shown in FIG. 1.

As shown in FIG. 4, the ceiling wall 335 is a double wall formed of an upper wall portion 336 and a lower wall portion 337. Multiple slits 336*a* are formed in the upper wall portion 336, and multiple penetration holes 337*a* are formed in the lower wall portion 337 so as to correspond to the multiple slits 336*a*.

As shown in FIG. 5, the slits 336*a* each have an oval shape extending in the conveyance direction of paper P and penetrate the upper wall portion 336 (see FIG. 4) in the thickness direction.

As shown in FIG. 5, the penetration holes 337*a* each are arranged to face one end part of the respective slits 336*a* and penetrate the lower wall portion 337 (see FIG. 4) in the thickness direction.

Figure 6:
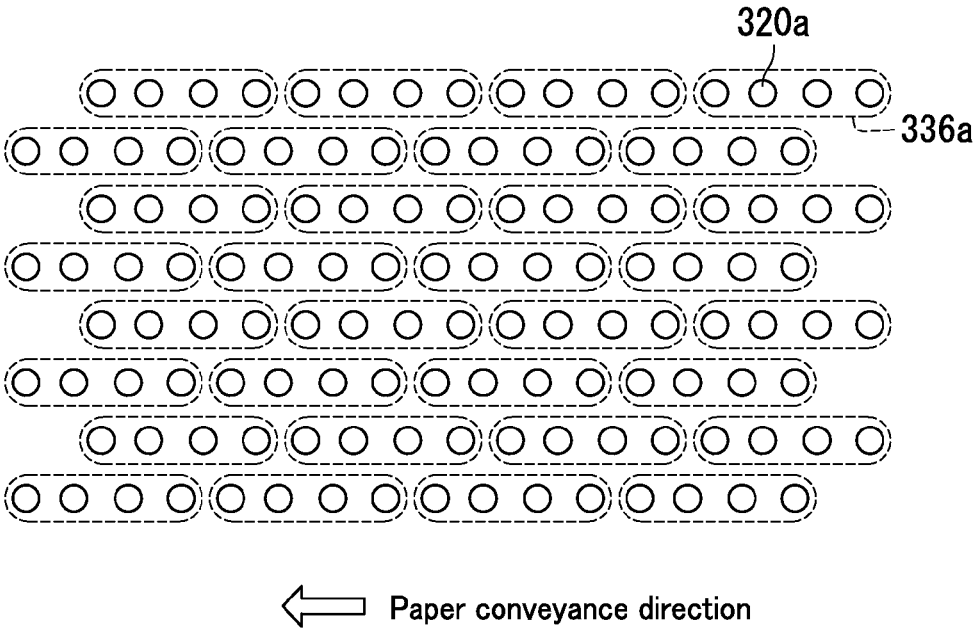
FIG. 6 is an explanatory illustration showing the relationship between suction holes of a conveyance belt and slits of the suction unit shown in FIG. 1.

FIG. 6 is an explanatory illustration showing the relationship between suction holes 320*a* of the conveyance belt 320 and the slits 336*a* of the suction unit 330 shown in FIG. 1.

Multiple suction holes 320*a* are formed in the conveyance belt 320 to penetrate the conveyance belt 320 in the thickness direction. A plurality of rows of the multiple suction holes 320*a* arranged in the conveyance direction of paper P are formed in the conveyance belt 320. The rows are arranged in a staggered manner in the width direction of the conveyance belt 320.

The slits 336*a* of the upper wall portion 336 are arranged to correspond to the suction holes 320*a* of the conveyance belt 320. A plurality of rows of the multiple slits 336*a* arranged in the conveyance direction of paper P are formed in the upper wall portion 336. The rows are arranged in a staggered manner in the width direction of the conveyance belt 320.

Each of the multiple slits 336*a* is formed to face four suction holes 320*a*. Four suction holes 320*a* facing the respective multiple slits 336*a* change in position one by one as the conveyance belt 320 advances.

Each of the cells 334A to 3341 (see FIG. 2) of the fan case 331 is in constant communication with a plurality of suction holes 320*a* of the multiple suction holes 320*a* of the conveyance belt 320 through the slits 336*a* and the penetration holes 337*a* of the ceiling wall 335 (see FIG. 4).

Next, operation and advantages of the inkjet recording apparatus 1 in the present embodiment will be described with reference to FIGS. 1-6. Herein, image formation on minimum sized paper P which the conveyor device 310 is capable of conveying will be described.

In FIG. 1, the paper feed roller 202 takes out the uppermost paper P of the multiple sheets of paper P accommodated in the paper feed cassette 201 in a layered manner from the paper feed cassette 201. The guide plate 203 guides the paper P to the first conveyance roller pair 402.

The first conveyance roller pair 402 sends out the paper P to the paper conveyance path 401. The second conveyance roller pair 403 conveys the paper P in the conveyance direction of the paper P. Then, the paper P abuts on the registration roller pair 404 and stops for skew correction on the paper P. Then, after the skew correction is performed, the paper P is sent out to the image forming section 300 with timing of printing.

The paper P is guided by the paper retention roller 312 onto the conveyance belt 320 and is loaded in the central part of the other surface of the conveyance belt 320 in the width direction. The paper P covers the suction holes 320*a* (see FIG. 6) formed in the conveyance belt 320 and is sucked on the other surface of the conveyance belt 320 by negative pressure supplied through the suction holes 320*a*. Then, the paper P is conveyed in the conveyance direction as the conveyance belt 320 advances.

Since the paper P is sucked to the central part of the other surface of the conveyance belt 320 in the width direction, the paper P passes above the cells 334F, 334E, and 334D of the fan case 331 in this order (see FIG. 3). When the paper P passes immediately above the cells 334F, 334E, or 334D, negative pressure in the cells 334F, 334E, or 334D reaches a maximum.

The cell 334E will be described as an example. As shown in FIG. 3, when paper P passes immediately above the cell 334E, four suction holes 320*a* of the conveyance belt 320 covered by the paper P overlap with all of the respective slits 336*a* (see FIG. 6) in communication with the cell 334E. Thus, all of the slits 336*a* in communication with the cell 334E are closed, so that the negative pressure in the cell 334E reaches the maximum. Accordingly, the paper P is sucked to the other surface of the conveyance belt 320 fixedly. Thus, the suction force of the suction unit 330 to small sized paper (e.g., postcard) can be increased. Also, the small sized paper can be prevented from coming off from the conveyance belt 320.

Figure 7:
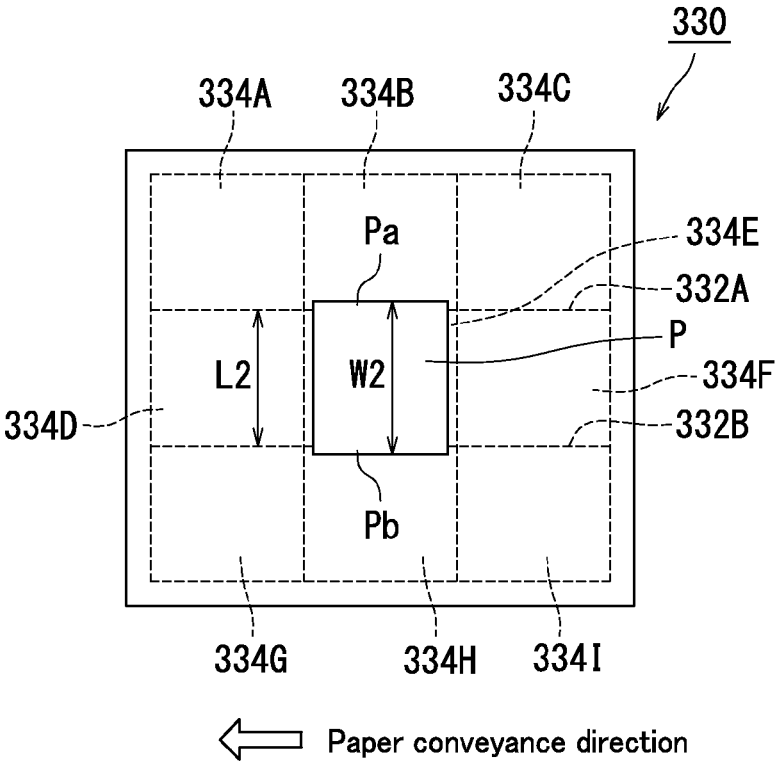
FIG. 7 is an explanatory illustration showing the relationship between the suction unit shown in FIG. 1 and paper.
Figure 8:
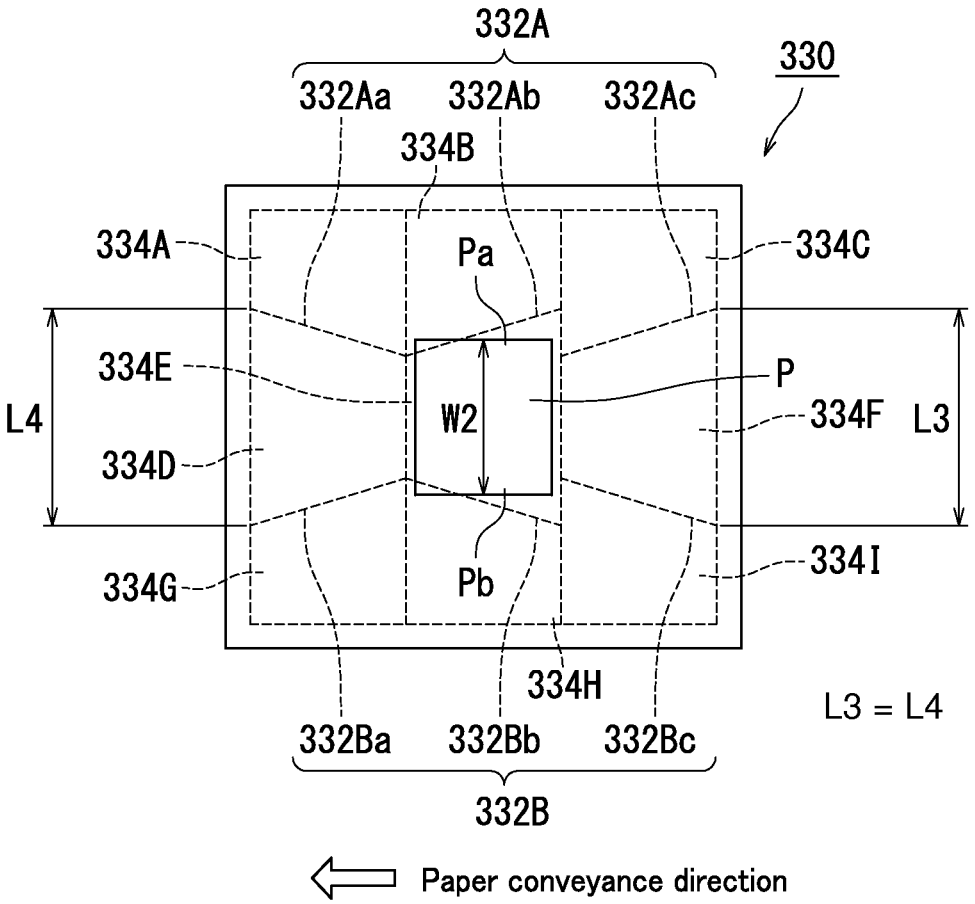
FIG. 8 is an illustration showing a suction unit of a conveyor device according to the second embodiment of the present disclosure.

Next, the second embodiment of the present disclosure will be described. FIG. 7 is an explanatory illustration showing the relationship between the suction unit shown in FIG. 1 and paper. FIG. 8 is an illustration showing a suction unit of a conveyor device according to the second embodiment of the present disclosure. The relationship between the suction unit in the second embodiment and paper will be described with reference to FIG. 8.

FIG. 7 shows a case in which in the suction unit 330 in the first embodiment 1, the width W2 of paper P is slightly larger (e.g., 1 cm) than the distance L2 between the pair of the partition walls 332A and 332B which forms and defines the cells 334D, 334E, and 334F. When such paper P is conveyed, side edge parts Pa and Pb in the conveyance direction of the paper P project outside the respective partition walls 332A and 332B. The cell 334E will be used as an example for describing this case.

When the slits 336*a* (see FIG. 6), which are in communication with the cells 334B and 334H arranged beside the cell 334E in the width direction of the conveyance belt 320, are not covered by the respective side edge parts Pa and Pb of the paper P, the suction force does not act on the side edge parts Pa and Pb of the paper P. Accordingly, the side edge parts Pa and Pb may come off from the other surface of the conveyance belt 320 by sag, wind pressure, or the like.

To tackle this problem, as shown in FIG. 8, in the second embodiment, a pair of partition walls 332A and 332B form and define the cells 334D, 334E, and 334F which face the central part of the conveyance belt 320 in the width direction and are arranged side by side in the conveyance direction of the paper P. The pair of partition walls 332A and 332B is arranged with a distance therebetween in the direction orthogonal to the conveyance direction of the paper P. The partition walls 332A and 332B are close to or separate from each other as they go downstream in the conveyance direction of the paper P.

In other words, the partition wall 332A is divided into a portion 332Aa defining the cell 334D, a portion 332Ab defining the cell 334E, and a portion 332Ac defining the cell 334F. Also, the partition wall 332B is divided into a portion 332Ba defining the cell 334D, a portion 332Bb defining the cell 334E, and a portion 332Bc defining the cell 334F.

In the cell 334D, the portion 332Aa and the portion 332Ba are separate from each other as they go downstream in the conveyance direction of paper P. Further, in the cell 334E, the portion 332Ab and the portion 332Bb are close to each other as they go downstream in the conveyance direction of the paper P. Further, in the cell 334F, the portion 332Ac and the portion 332Bc are close to each other as they go downstream in the conveyance direction of the paper P.

In this case, as the paper P advances, one side edge part Pa of the paper P crosses the portion 332Ac, the portion 332Ab, and the portion 332Aa in this order, and the other side edge part Pb of the paper P crosses the portion 332Bc, the portion 332Bb, and the portion 332Ba in this order. Accordingly, no case in which the suction force to the side edge parts Pa and Pb is reduced to zero occurs, unlike the case of FIG. 7, but the suction force always acts on part of the respective side edge parts Pa and Pb. Thus, the side edge parts Pa and Pb can be prevented from coming off from the conveyance belt 320.

Further, in the cell 334F located the most upstream in the conveyance direction of paper P, the suction force at the upper surface of the cell 334F is large on the upstream side of the conveyance direction of the paper P since the portion 332Ac and the portion 332Bc are close to each other as they go downstream in the conveyance direction of the paper P. Accordingly, the paper P moving above the cell 334F can be sucked fixedly. Thus, displacement of the paper P on the conveyance belt 320, which may be caused by the registration roller pair 404 pulling the paper P, can be reduced. Furthermore, in the present embodiment, the distance between the portion 332Ac and the portion 332Bc in the width direction of the conveyance belt 320 is maximum at the most upstream point in the conveyance direction of the paper P. Further, the maximum distance L3 between the portion 332Ac and the portion 332Bc is larger than the width W2 of the paper P. Thus, the entire front end part of the paper P moving above the cell 334F can be sucked fixedly. It is noted that the distance L3 can be smaller than the width W2 to the extent that the suction force does not adversely affect the front end part of the paper P.

The portion 332Ab and the portion 332Bb of cell 334E may be formed similarly to the portion 332Ac and the portion 332Bc, respectively so that the portions 332Ab and 332Bb are close to each other as they go downstream in the conveyance direction of the paper P. This can increase the suction force on the upstream side in the conveyance direction of the paper P above the cell 334E. Thus, displacement of the paper P, which may be caused by pulling the paper P toward the cell 334F, can be reduced.

Further, in the cell 334D located the most downstream in the conveyance direction of paper P, the suction force at the upper surface of the cell 334D is large on the downstream side of the conveyance direction of the paper P since the portion 332Aa and the portion 332Ba are separate from each other as they go downstream in the conveyance direction of the paper P. Accordingly, the rear end part of the paper P moving away from the upper surface of the cell 334D can be sucked fixedly. Thus, displacement of the paper P on the conveyance belt 320, which may be caused by the ejection roller pair 501 pulling the paper P, can be reduced.

Furthermore, in the present embodiment, the distance between the portion 332Aa and the portion 332Ba in the width direction of the conveyance belt 320 is the maximum at the most downstream point in the conveyance direction of the paper P. Note that the maximum distance L is equal to the maximum distance L3. In other words, each of the maximum distances L4 and L3 is a maximum distance of a pair of partition walls in the width direction of the conveyance belt 320. Further, the maximum distance L4 between the portion 332Aa and the portion 332Ba is larger than the width W2 of paper P. Thus, the entire rear end part of the paper P moving away from the upper surface of the cell 334D can be sucked fixedly. It is noted that the distance L4 can be smaller than the width W2 to the extent that the suction force does not adversely affect the rear end part of the paper P.

The specific embodiments of the present disclosure have been described above. However, the present disclosure is not limited to the above described embodiments. Various types of alteration are applicable to the above described embodiments.

For example, in the above described embodiments, the case has been described in which the plurality of cells are arranged side by side in the width direction of the conveyance belt and in the conveyance direction of paper in the interior of the unit case. However, a plurality of cells can be arranged side by side only in the width direction of the conveyance belt in the interior of the unit case.

Further, in the above described embodiments, the pair of partition walls is formed and arranged with a distance therebetween in the direction orthogonal to the conveyance direction of paper so as to be close to or separate from each other as they go downstream in the conveyance direction of the paper in the cells facing the central part of the conveyance belt in the width direction. However, a pair of partition walls can be formed and arranged with a distance therebetween in a direction orthogonal to a conveyance direction of paper so as to be close to or separate from each other as they go downstream in the conveyance direction of the paper in the other cells.

Further, in the above described embodiments, the fan is used as a suction section. However, any other suction section (e.g., vacuum pump) can be employed. In addition, the suction section is provided in the interior of each cell in the above embodiment, but may be provided external to the each cell.

Further, in the above described embodiments, the case in which the present disclosure is applied to an inkjet recording apparatus including a line type recording head has been described. However, the present disclosure may be applicable to an inkjet recording apparatus including a serial type recording head.

Furthermore, in the above described embodiments, the case in which the present disclosure is applied to an inkjet recording apparatus has been described. However, the present disclosure is applicable also to any other image forming apparatuses (e.g., electrophotographic image forming apparatuses).

In addition, in the above described embodiments, the case in which the recording medium is paper has been described. However, recording mediums other than the paper may be used, such as resin sheets and cloth.

Besides, various types of alteration are applicable to the above described embodiments within the scope not departing from the subject matter of the present disclosure.

What is claimed is:

1. A conveyor device which conveys a recording medium, comprising:

a conveyance belt in which multiple suction holes are formed and which is driven in a conveyance direction of the recording medium; and a suction unit arranged on one of surfaces of the conveyance belt and configured to generate negative pressure to suck the recording medium on the other surface of the conveyance belt through the multiple suction holes, wherein the suction unit includes:

a unit case including a plurality of cells arranged side by side at least in a width direction of the conveyance belt, a suction section provided in each of the plurality of cells and configured to generate the negative pressure, at least one of the plurality of cells is defined and formed by a pair of flat partition walls, the pair of partition walls is arranged with a distance therebetween in a direction orthogonal to the conveyance direction, and the distance between the pair of partition walls gets smaller or larger as they go downstream in the conveyance direction.

2. A conveyor device according to claim 1, wherein the at least one of the plurality of cells is a cell located the most upstream in the conveyance direction, and the distance between the partition walls gets smaller as they go downstream in the conveyance direction.

3. A conveyor device according to claim 2, wherein a maximum distance between the pair of partition walls in the width direction of the conveyance belt is larger than a width of a minimum sized recording medium, which the conveyance belt is capable of conveying, in the width direction of the conveyance belt.

4. A conveyor device according to claim 3, wherein a distance between the pair of partition walls in the width direction is maximum at a most upstream point in the conveyance direction.

5. A conveyor device according to claim 1, wherein the at least one of the plurality of cells is a cell located the most downstream in the conveyance direction, and the distance between the partition walls gets larger as they go downstream in the conveyance direction.

6. A conveyor device according to claim 5, wherein a maximum distance between the pair of partition walls in the width direction of the conveyance belt is larger than a width of a minimum sized recording medium, which the conveyance belt is capable of conveying, in the width direction of the conveyance belt.

7. A conveyor device according to claim 6, wherein a distance between the pair of partition walls in the width direction is maximum at a most downstream point in the conveyance direction.

8. A conveyor device according to claim 1, wherein the at least one of the plurality of cells includes a cell located the most upstream in the conveyance direction and a cell located the most downstream in the conveyance direction, a distance between the partition walls which form and define the cell located the most upstream gets smaller as they go downstream in the conveyance direction, and a distance between the partition walls which form and define the cell located the most downstream gets larger as they go downstream in the conveyance direction.

9. A conveyor device according to claim 1, wherein the at least one of the plurality of cells includes a cell located the most upstream in the conveyance direction, a cell located the most downstream in the conveyance direction, and a cell located between the cell located the most upstream and the cell located the most downstream, and a distance between the partition walls which define and form the cell located between the cell located the most upstream and the cell located the most downstream gets smaller as they go downstream in the conveyance direction.

10. A conveyor device according to claim 1, wherein the suction section includes a fan.

11. An image forming apparatus, comprising:

a conveyor device configured to convey a recording medium; and an image forming section configured to form an image on the recording medium, wherein the conveyor device includes:

a conveyance belt in which multiple suction holes are formed and which is driven in a conveyance direction of the recording medium; and a suction unit arranged on one of surfaces of the conveyance belt and configured to generate negative pressure to suck the recording medium on the other surface of the conveyance belt through the multiple suction holes, and the suction unit includes:

a unit case including a plurality of cells arranged side by side at least in a width direction of the conveyance belt; and a suction section provided in each of the plurality of cells and configured to generate the negative pressure, at least one of the plurality of cells is defined and formed by a pair of flat partition walls, the pair of partition walls is arranged with a distance therebetween in a direction orthogonal to the conveyance direction, and the distance between the pair of partition walls gets smaller as they go downstream in the conveyance direction or larger as they go downstream in the conveyance direction.

12. An image forming apparatus according to claim 11, wherein the image forming section employs an inkjet recording method.

* * * * *